US005088558A

United States Patent [19]

Mohn

[11] Patent Number: 5,088,558

[45] Date of Patent: Feb. 18, 1992

[54] UNDERSEA PACKAGE AND INSTALLATION SYSTEM

[76] Inventor: Frank Mohn, 108 Coombe Lane, London, England, SW20 0AY

[21] Appl. No.: 598,738

[22] PCT Filed: Feb. 23, 1990

[86] PCT No.: PCT/GB90/00292

§ 371 Date: Nov. 28, 1990

§ 102(e) Date: Nov. 28, 1990

[87] PCT Pub. No.: WO90/10139

PCT Pub. Date: Sep. 7, 1990

[30] Foreign Application Priority Data

Feb. 24, 1989 [GB] United Kingdom ..... 8904295

[51] Int. Cl.[5] ..... E21B 43/01

[52] U.S. Cl. ..... 166/339; 166/341; 166/344; 166/343; 166/360; 166/368; 166/65.1; 285/137.1; 285/346

[58] Field of Search ..... 166/338, 339, 341, 343, 166/344, 347, 351, 360, 368, 65.1; 285/25, 137.1, 346, 348; 405/128, 190, 191; 439/137, 194, 191

[56] References Cited

U.S. PATENT DOCUMENTS 3,486,556 12/1969 Burgess ..... 166/338

4,278,362 7/1981 Scherrer ..... 166/339

4,863,314 9/1989 Baugh ..... 166/338

4,899,822 2/1990 Daeschler et al. ..... 166/339

*Primary Examiner*—Stephen J. Novosad

*Attorney, Agent, or Firm*—Young & Thompson

[57] ABSTRACT

An operational package comprising either a pump/-driver package (1; 100), or a valve package (250) is retrievably installed at a subsea station by a receptacle (10; 110; 251). Co-operating connection means on the package and the receptacle establish fluid and/or electrical connection between the package and the receptacle on reception of the package within the receptacle. Seal means (14) carried by the package are moved into a condition to seal any such fluid connections. Installation is effected by establishing a running loop extending from a surface vessel downwardly through the receptacle (10; 110) and upwardly to the surface vessel outside the receptacle, the package (1; 100) being moved on and guided by the wire loop from the surface vessel into the receptacle. Alternatively, a handling tool (120) is employed with co-operating releasable connecting means (151) on the handling tool and the receptacle, and operating means (124, 125) operable between the handling tool and the package to effect movement of the package inwardly of the receptacle, after connection of the connecting means.

18 Claims, 12 Drawing Sheets.

FIG. 20
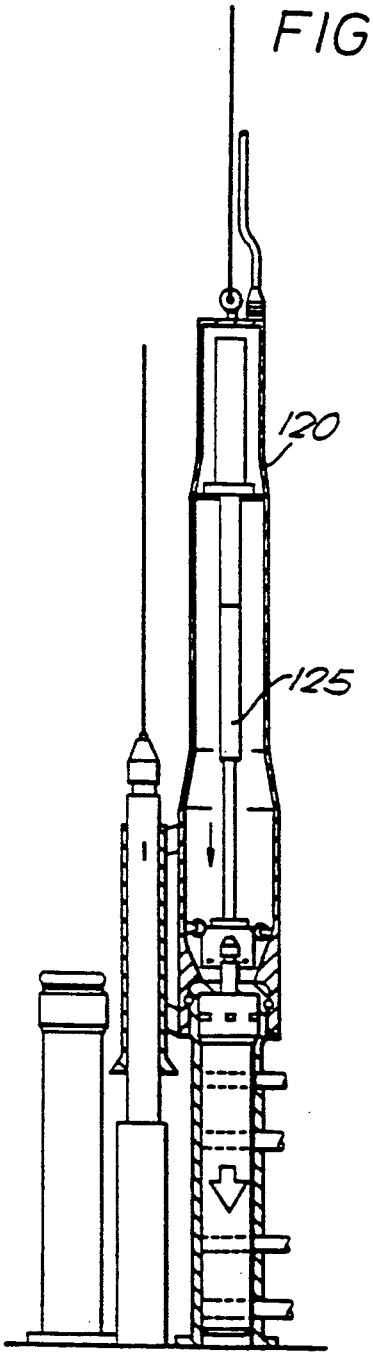
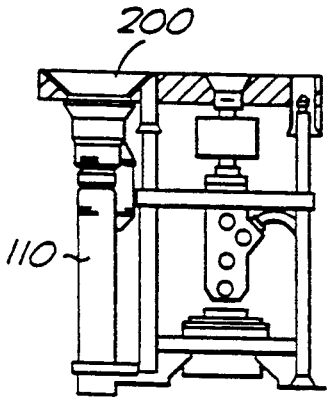
FIG. 22
FIG. 21
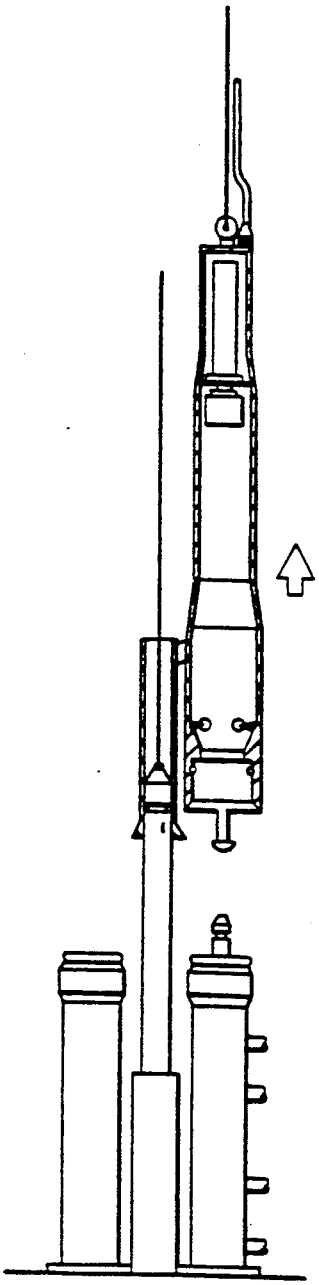

UNDERSEA PACKAGE AND INSTALLATION SYSTEM

DESCRIPTION

The invention relates to installation of equipment at subsea stations, and in particular to the installation of operational equipment, for example, pumping and valve packages.

Pumping equipment in undersea pump stations normally requires maintenance or replacement during the life of the station. Maintenance requires to be carried out at the surface, so it has to be possible for the pump equipment to be separated from the station and retrieved to surface and thereafter installed and reconnected into the station. Electrical and/or fluid connections then have to be made, and difficulties arise in handling, connection and sealing. In conventional arrangements, for example, a retrievable motor unit has first to be brought to its required position relative to the subsea station and then the necessary connections have to be established as a seprate step, which involves operations of a different kind, at a different location.

Valve equipment, for example, a multiport valve unit for switching between two pumps at the subsea station, similarly tends to require replacement because of leakage problems due to wear. The valve equipment then requires to be removed from the subsea station for maintenance at the surface after which it has to be returned and the necessary connections re-established.

Installation of equipment at an undersea station can thus be complicated and time consuming, and the invention is concerned with the provision of means for alleviating the difficulties involved.

In accordance with the invention there is provided undersea equipment in the form of a unit or package which contains not only the appropriate operational elements but which integrally incorporates the necessary connections to the subsea station. A package of the invention is preferably so arranged so that installation of the package into a suitable connector or receptacle provided at the subsea station is integrated with the establishment of appropriate connections and any appropriate sealing means. As compared with conventional arrangements, installation in accordance with the invention is considerably simplified. A unit or package has merely to be centred along the direction in which it must move to reach the installed position and the establishment of electrical and/or fluid connections then follows as a consequence of movement to the final position.

The invention can thus be embodied in a pump/-driver package containing pumping elements and driving means therefor, together with connection means for fluid communication, and also electrical communication if appropriate, with connection means at a subsea station at which the package is to be installed. The package is conveniently of elongate circular cylindrical form, for reception in a tubular receptacle located at the subsea station and provided with connection means at positions of registration with the package connection means.

The invention can also be embodied in a valve package, which can again be of elongate circular cylindrical form, with fluid connection ports at its outer surface. The package can again be received within a receptacle provided with fluid connection ports for registration with the fluid ports of the package. The valve mechanism of the package can be operable by fluid pressure or electrically.

In any package in accordance with the invention which requires fluid connection with the undersea installation, sealing means for ensuring integrity of the fluid communications between the fluid ports of the package and those of the receptacle are provided, conveniently on the package, the sealing means preferably being made effective as a consequence of, or during, the final stage of entry of the package into the receptacle.

A package of the invention can thus incorporate sealing rings which are inoperative when the package is initially received within the connector receptacle but which can then be rendered effective between the package and the connector wall around it. The sealing rings can thus be deformed by relative movement of support rings between which each is received axially of the package, conveniently under fluid pressure. The package can be supported on shoulders with the bore of the receptacle, and forced further inwardly to effect the movement of the support rings against resistance provided by the engagement of a handling tool from which the package extends with the receptacle.

For establishment of electrical communication between a package in accordance with the invention and the undersea station, the package can incorporate external contact elements for engagement with cooperating elements exposed within the receptacle. Advantageously, the contact elements can be protected during movement to the subsea station by a cover member, which is displaced by engagement with the subsea connector or receptacle on installation. For example, a sleeve around a portion of the package mounting ring contacts can be displaced by the connector to expose the contacts. Similar arrangements can be provided for contacts carried by the connector. The cover members are preferably spring-biassed into their operative positions, so that these are resumed when the package is retrieved from the undersea station.

Provision can be made for flushing of the contacts by a suitable flushing fluid, typically a protective oil, during installation, and if desired thereafter during normal operation.

The invention also provides advantageous arrangements for guiding such a package or unit to its predetermined location in the subsea installation, and for its eventual retrieval.

The invention provides a system for installation of a package at a subsea station in which a line is run downwardly from a surface vessel through a hollow receptacle for the unit provided at the station, and is then returned upwardly to the vessel, so that the package can be guided into the receptacle along the line. The line can extend to a heave compensated pulley system on the surface vessel and can be operated by two winches, one to extend the line and one to pull it in.

The line may be simply severed after installation, but a lower free end may be secured to a suitable support at the station, for example a support bracket externally of the receptacle, for subsequent reconnection when the package is to be retrieved to surface. The package is then guided by a running loop during retrieval, instead of being freely suspended.

The handling equipment required by such a system is compact and is easily handled on the surface vessel. Installation does not require to be closely monitored as the unit is not free-swimming, and a remotely operated vehicle (ROV) can be employed without being required to perform any but conventional functions. At the subsea station, the guidance provided by the running line avoids the need for guide funnels. The possibility of damaging impact to the station is avoided by use of the line and there is no impact load transferred to the station, nor are shock absorbers required.

The installation system of the invention is readily applicable to installation of a pump/driver or valving package to a subsea pumping station at which the receptacle in the form of an upright tube is supported by a frame around a Xmas tree. The receptacle can be positioned close to the tree and does not impose excessive support requirements on the frame.

The invention also provides a system for installation of a package at a subsea station in which the package is installed by means of a handling tool within which it is substantially enclosed. The package is thus effectively protected during movement to the subsea station and during transfer from the tool into the connector receptacle.

Preferably the tool has an open end projecting downwardly beyond the package, by which it can be latched to the receptacle, so as to ensure precise axial alignment between the package and the receptacle. The invention also provides an installation system for a package assembled with such a handling tool in which the tool is guided by an entrance funnel into a predetermined relationship with the receptacle from which transfer of the package from the tool into the receptacle can be effected. Shock absorption means can be provided if appropriate. Provision can again be made for the setting up of sealing rings as described above.

In an alternative installation system, the unit inside its handling tool is guided into its installation relationship with the receptacle by guidelines and guideposts.

When embodied in an electrically driven pump package, the invention preferably provides for an integrated lubricating, protection and cooling oil system. The oil can also be employed to flush the electrical contacts between the package and the receptacle, preferably not only during installation but also during normal operation. Oil circulation can be provided by an impeller directly mounted on the motor shaft. The impeller has only to provide a pressure to overcome the frictional losses within the unit itself. Static oil pressure can be provided by an external oil supply preferably by way of the power cable or umbilical and coupled to the unit in the region of its electric contacts Oil must be supplied to the unit because the pump shaft seal will leak a small amount of oil during operation. The oil could be permitted to some extent to lubricate the pump bearings. In standby mode, when the unit is inoperative, it is desirable to have external control of the oil.

An oil reservoir and pressure control system can be incorporated in the retrievable package or can take the form of a separate tank unit intalled at the subsea station.

The oil lubrication system advantageously includes oil filters and/or an oil cooler. Sensors providing signals for status monitoring may be included and may be directly coupled to surface monitoring equipment by way of separate contacts and conductors or by way of multiplexing on to the power conductors.

The invention is further described below, by way of example, with reference to the accompanying drawings, in which:

FIGS. 1A and 1B are sectional side views of the upper and lower parts only of a first pump/driver unit or package received in a tubular receptacle at a subsea station in accordance with the invention, just after installation by an installation connector partly shown at the top of FIG. 1A; the left and right hand sides of the figures show the condition of the package after and prior to the setting of seal rings;

FIGS. 18–21 are views similar to that of FIG. 17, illustrating successive stages of the installation of the package of FIGS. 14A and 14B at a subsea station, using the handling tool of FIG. 17;

FIG. 22 is a side view of a subsea station having a connector receptacle for receiving the pump/driver package and handling tool assembly of FIG. 17, but by a further installation system;

Figure 17:
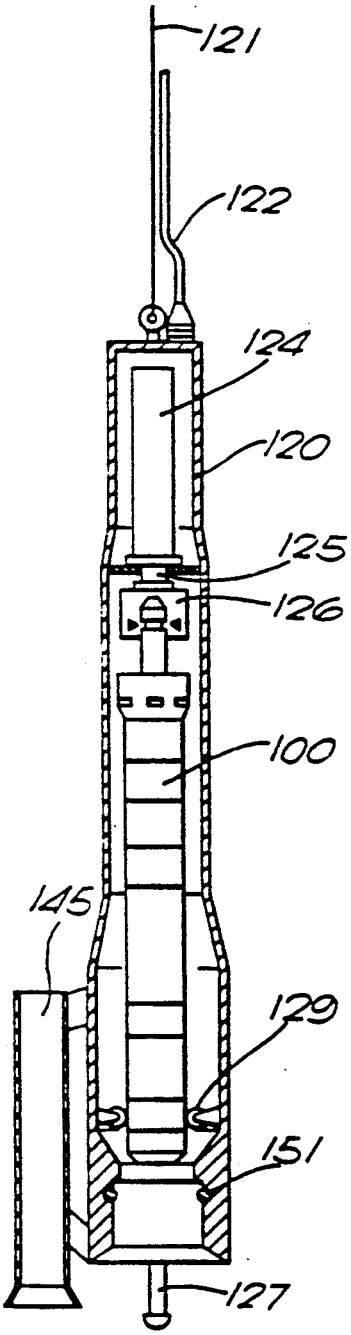
FIG. 17 is a schematic sectional side view on a smaller scale of the pump/driver package of FIGS. 14A and 14B received within a handling tool.
Figure 23:
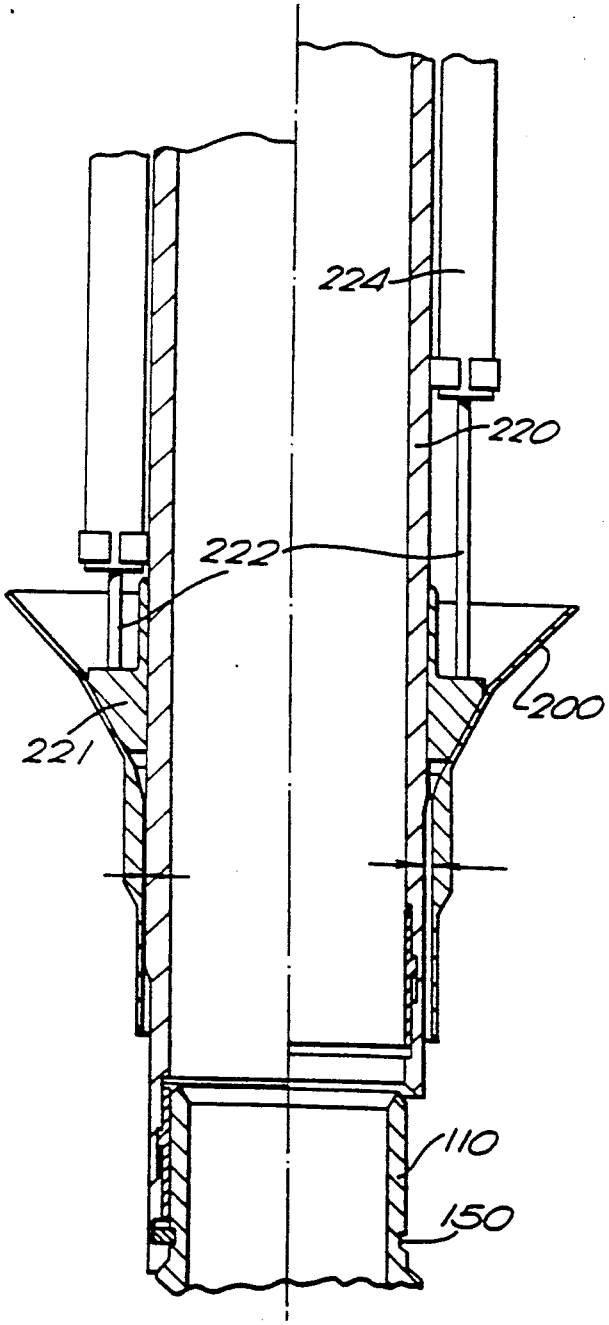
Figure 24:
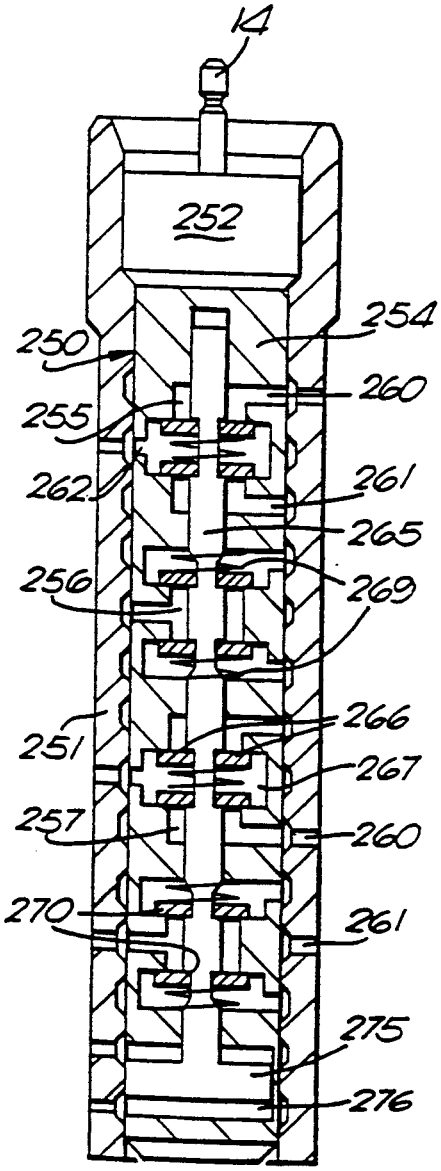

FIG. 23 is a partial sectional side view, on a larger scale, illustrating installation of the pump/driver handling tool assembly of FIG. 17 at the subsea station of FIG. 22 by the further system; and FIG. 24 is a sectional side view of a valve package installed within a receptacle by an installation system similar to the installation systems illustrated in FIGS. 4–8, FIGS. 10 and 11, FIGS. 18–21 or FIGS. 22 and 23.

Figure 1A:
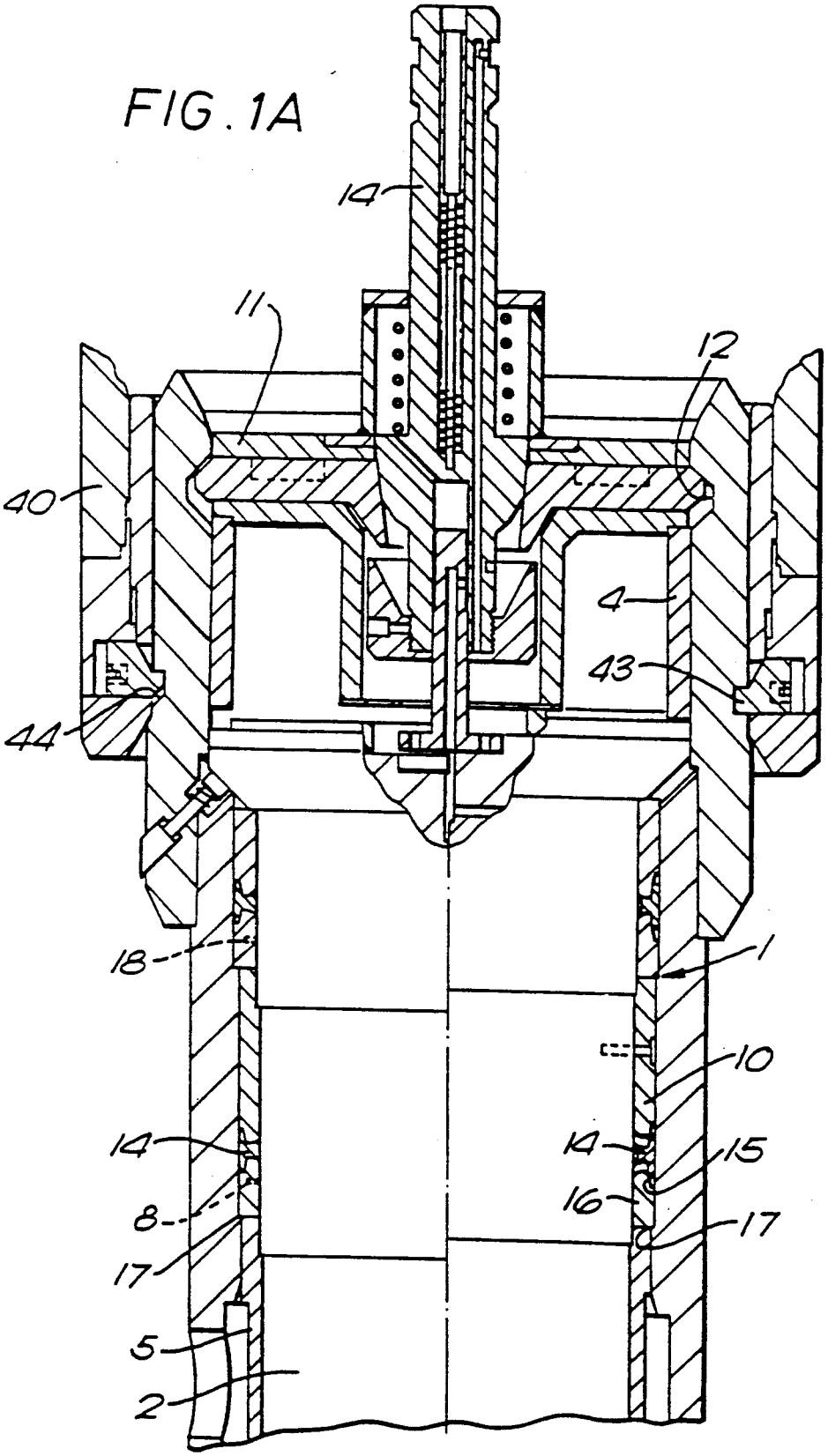
Figure 1B:
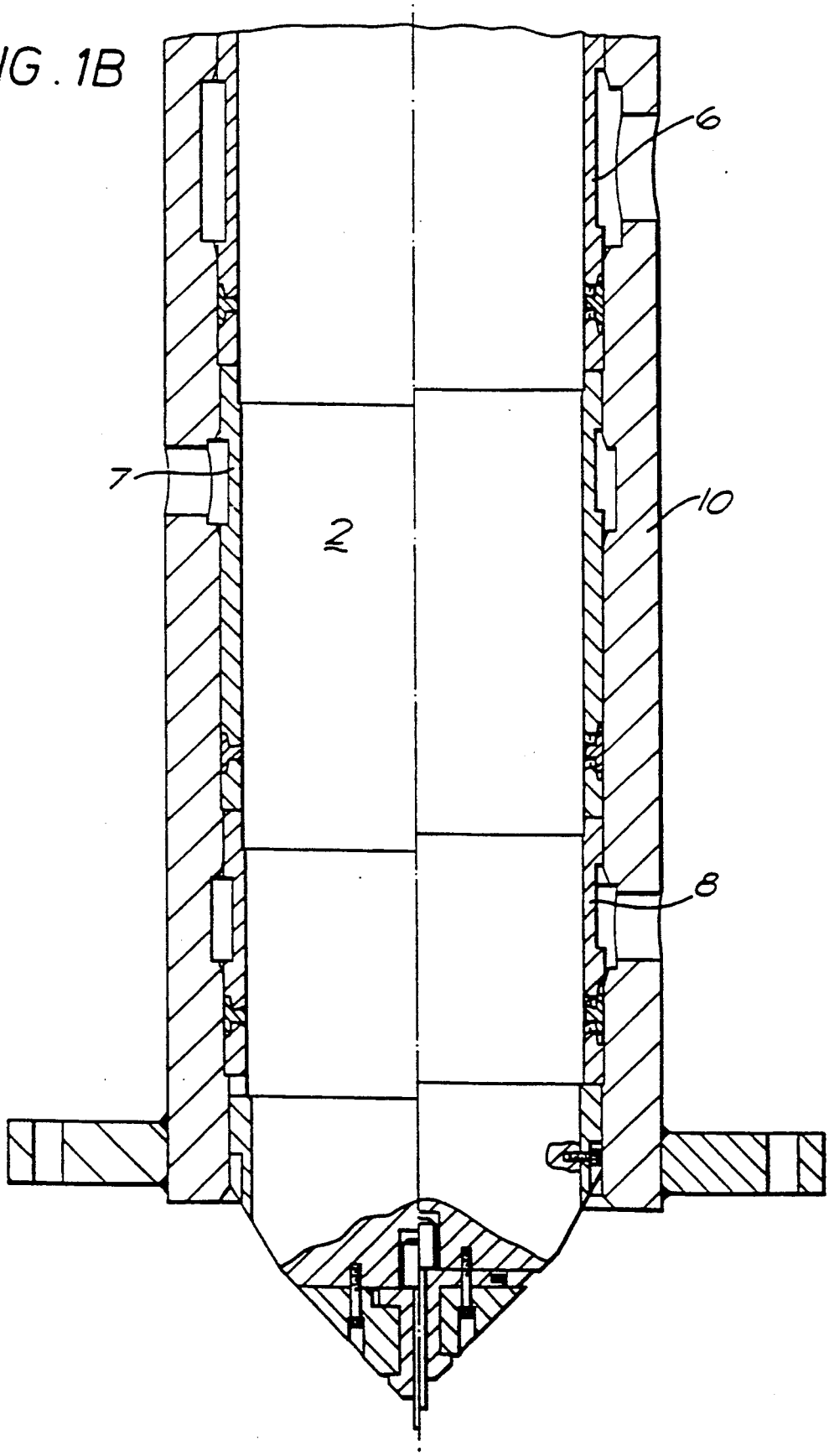

The pump/driver package 1 illustrated in FIGS. 1A and 1B comprises a generally circular cylindrical body 2 with a tapered lower end, extending downwardly from a suspension or locking head 4 of slightly greater diameter The body 2 contains a turbine for driving pump elements for moving fluid from an inlet port 5 in its side wall to a discharge port 6 also located in the body side wall. Inlet and outlet ports 7 and 8 are provided for hydraulic fluid for powering the turbine. Where the package is to pump mixed phase fluids, a mixing device as described in Application EP 90 300 391.1 (FD17) can be included within the package to effect homogenization of the flowing fluid and thus facilitate the pumping action.

The package 1 is shown in FIGS. 1A and 1B received within a receptacle 10 of a subsea pumping station, the receptacle having the form of an upright sleeve within which the package makes a close fit. The package 1 is locked or latched within the receptacle 10 by locking elements 11 radially outwardly extensible from the head 4 for reception in an internal groove 12 provided at the upper end of the receptacle. An umbilical connector 14 extends upwardly from the head 4 for connection of an hydraulic supply necessary for installation of the package. The cylindrical wall of the receptacle 10 is provided with inlet and discharge port and which register with the ports 5 and 6, and also the turbine ports 7 and 8, of the body 2 to communicate the package with the subsea station.

Integrity of communication between the ports in the wall of the body 2 and those extending through the receptacle wall is ensured by sealing means comprising ring-like sealing elements 14 shown as received in peripheral grooves 15 extending around the body 1.

The sealing means design is such that on entry of the package 1 into the receptacle 10, the sealing elements 14 sit passively in the grooves 15 between support rings 16, as shown at the right hand side of FIG. 1A. The receptacle bore has portions of successively smaller diameter in the downward direction separated by five shoulders 17. When the package 1 enters the receptacle 10, it comes to rest on the shoulders 17, as indicated to the right in FIG. 1A. The body 2 is then forced further into the receptacle under fluid pressure. This further movement shears retainer pins 18 carried by the support rings 16 associated with the sealing elements 14 to enable the support rings to move upwardly and set the sealing elements, as shown to the left of FIG. 1A. Each sealing ring or element 14 has upwardly and downwardly facing grooves into which adjacent portions of the support rings enter to urge the sealing element to close the gap between the body 2 and the receptacle 10.

A system of installation for the pump/driver package 1 is now described with reference to FIGS. 2–8.

The receptacle 10 is mounted at the subsea station by a support frame 20 around a tree 21.

Figure 4:
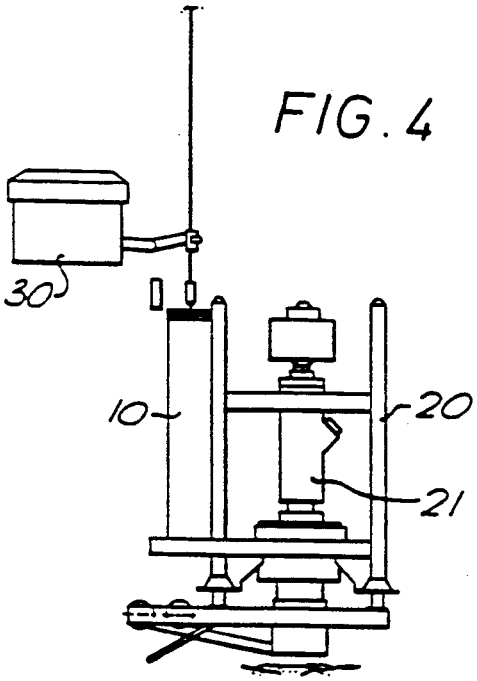
FIGS. 4–8 are schematic side views on a smaller scale illustrating the installation of the pump/driver package of FIGS. 1A and 1B at the subsea station.
Figure 5:
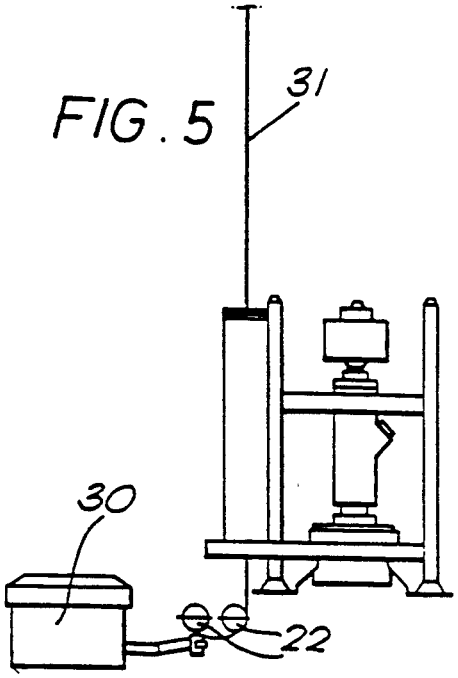

Initially, as shown in FIG. 4, a remotely operated vehicle (ROV) 30 carries a length of plastics coated running wire, which is being lowered from a surface vessel, so that its lower end passes through the receptacle 10. The frame 20 supports beneath the lower end of the receptacle a pair of roller sheaves 22, and the ROV retrieves the wire after its free end has passed through the receptacle and trains the wire around a first of the sheaves which is positioned so that a first run 31 of the wire then extends to the sheave along the axis of the receptacle. The ROV then takes the wire horizontally to the second sheave, as shown in FIG. 5, and guides it to extend upwardly, laterally spaced from the receptacle, to the surface vessel to establish a second run 32. At the vessel, both wire runs are supported on a heave compensator pulley system and the ends are attached to winches.

Figure 2:
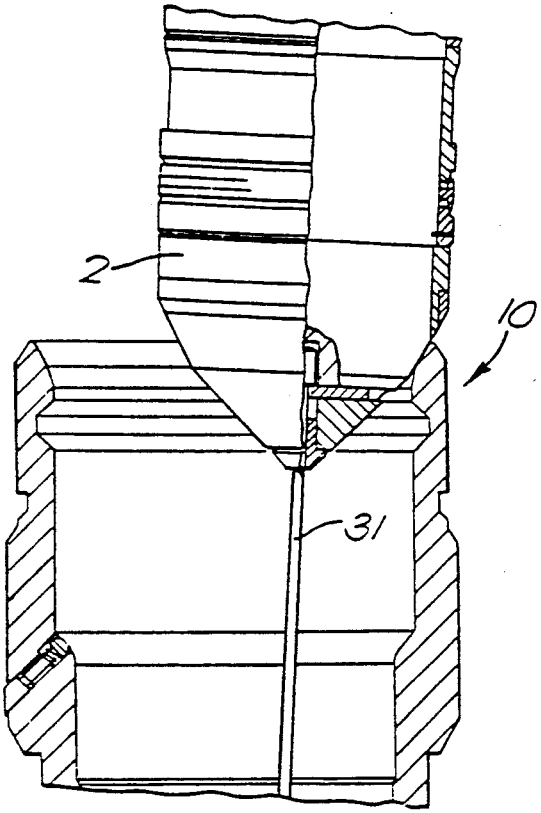
FIGS. 2 and 3 are partial sectional side views showing successive stages of the entry of the pump/driver unit of FIGS. 1A and 1B into the receptacle.
Figure 3:
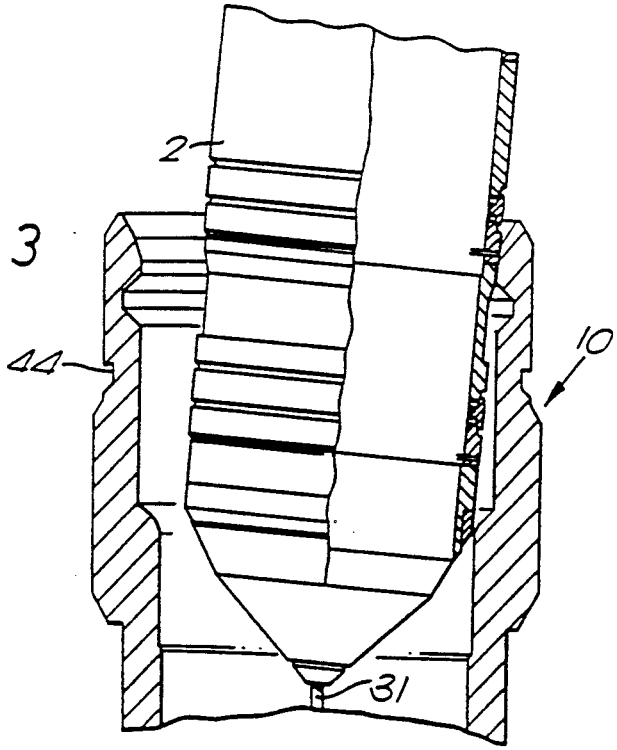
Figure 6:
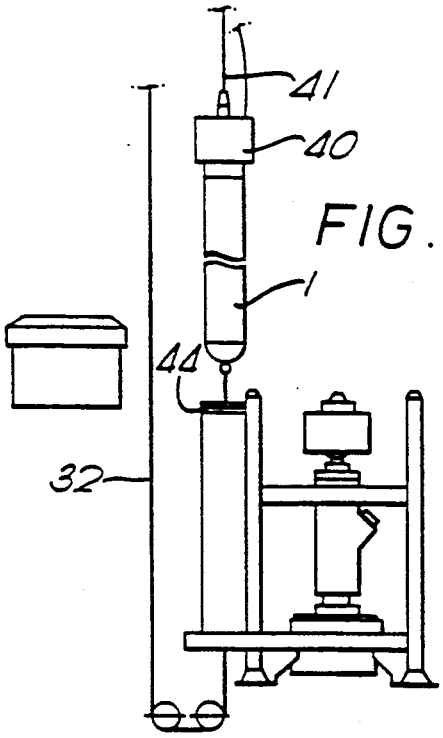

The pump/driver package 1 can then be winched down the first wire run 31 towards the first sheave 22, as shown in FIG. 6. The package 1 is suspended at this stage by a hydraulic handling tool 40 which is controlled and powered from the surface vessel by way of an hydraulic umbilical 41. The entry of the package 1 into the connector receptacle 10 can be supervised by the ROV. Because the package 1 and tool 40 are not free swimming but are guided by the wire run 31, entry into the receptacle is readily effected. As shown in FIGS. 2 and 3, the tapered nose of the package 1 can co-operate with an outwardly flared upper end of the receptacle interior to accommodate a certain amount of angular misalignment between the wire run 31 and the axis of the receptacle 10.

Figure 7:
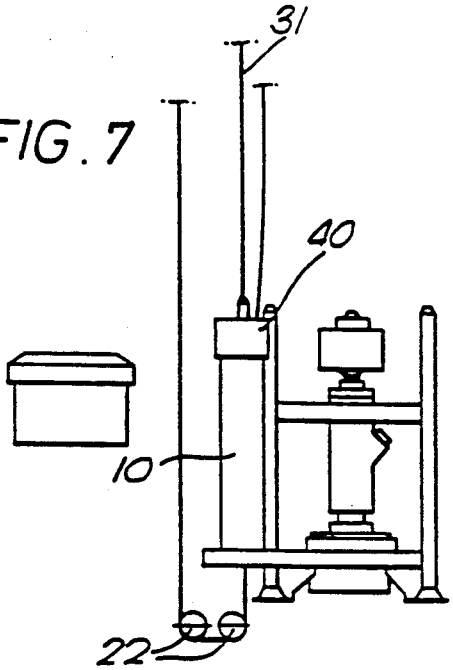

FIG. 7 shows the package 1 installed within the receptacle 10, which is provided externally at its upper end with a profiled groove 44 for latching engagement by latch members 43 of the handling tool 40. This latching arrangement enables hydraulic pressure supplied through the umbilical 41 to be applied to move outwardly the elements 11 to latch the head 4 to the upper part of the receptacle and to load the body 2 axially, so as to set the seal elements 14. The integrity of the seals thus established is then tested, again by way of fluid pressure through the umbilical 41.

Figure 8:
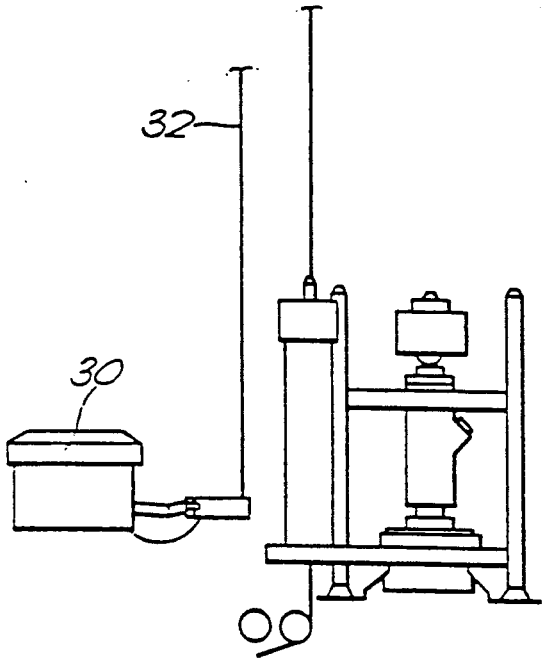

Testing having been completed, the package 1 has been duly installed and the ROV cuts the wire run 32, as shown in FIG. 8, and the upper length of this run is retrieved to the surface vessel. The hydraulic handling tool 40 is released from the receptacle 10 by the ROV 30 and is also retrieved to surface, with the umbilical 41, by the wire run 31 connected to it.

Figure 9:
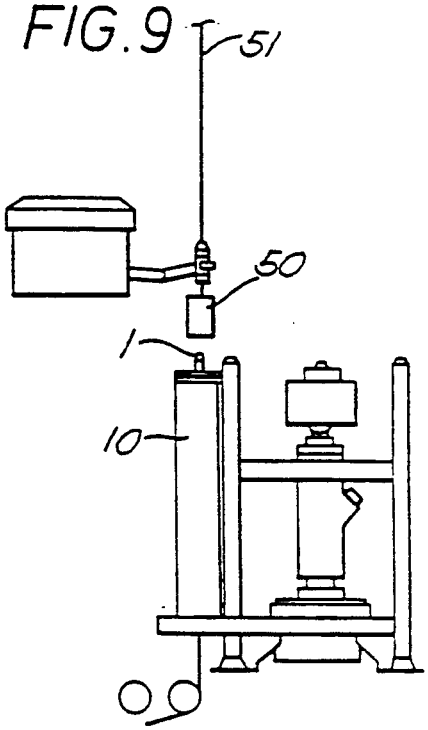
FIG. 9 is a similar view illustrating retrieval of the package.
Figure 10:
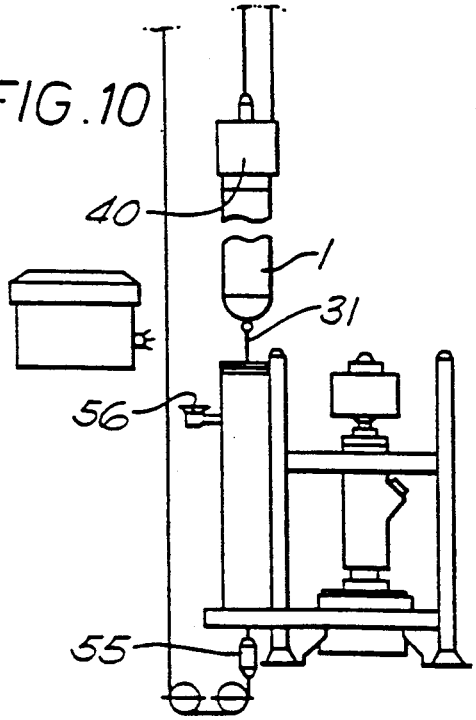
FIGS. 10 & 11 are views similar to those of FIGS. 4–9 but illustrating installation of the package in accordance with a modified system.

When the pump/driver package is to be retrieved from the subsea station, a handling tool 50 is lowered by means of a running wire 51 as shown in FIG. 9 and connected by the ROV to the upper end of the package which can then be hauled up to the surface vessel.

In the modified installation system shown in FIGS. 10–13, the running wire is provided with a separable link 55 which can be connected and disconnected by the ROV, so that one end can be retained at the subsea station. It can then be employed in retrieval of the package.

Figure 11:
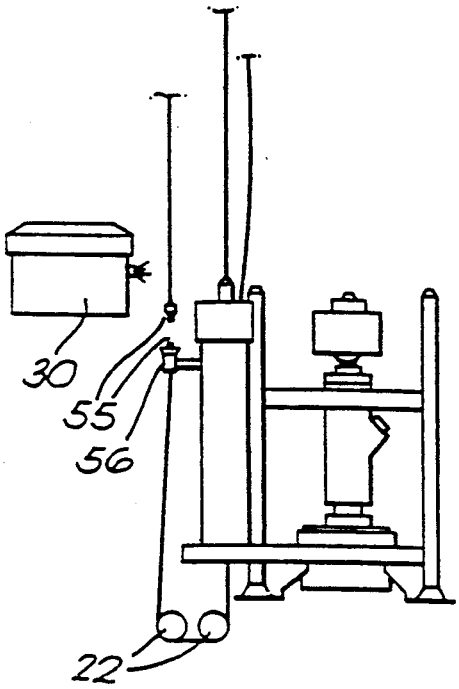
Figure 12:
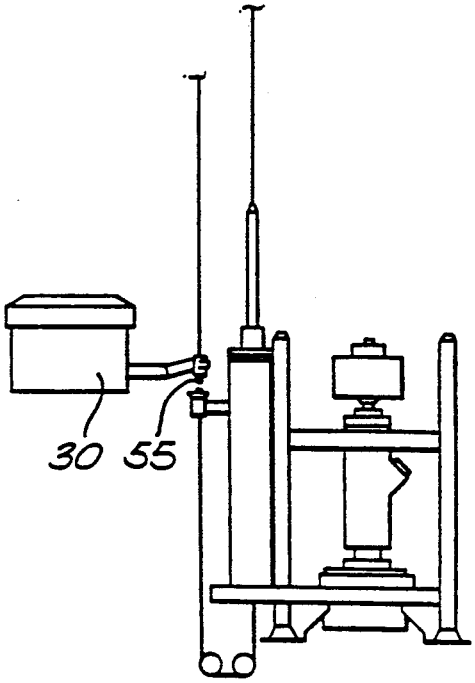
FIGS. 12 and 13 are similar views illustrating retrieval of the package in accordance with the modified system.

The receptacle 10 is provided with a support bracket 56 extending laterally from near its upper end, to which a portion of the link 55 can be detachably secured. Installation of the package takes place as described with reference to FIGS. 4–8 as will appear from comparison of FIG. 10 with FIG. 6, and the package is locked down and the seals set and tested as before. Instead of cutting the wire, the ROV then separates the link 55 and secures the link portion at the end of the wire extending upwardly from the sheaves 22 to the support bracket 56, as shown in FIG. 11. The upper end of the return line is then pulled to the surface vessel, as is the handling tool 40 after release from the receptacle 10.

Figure 13:
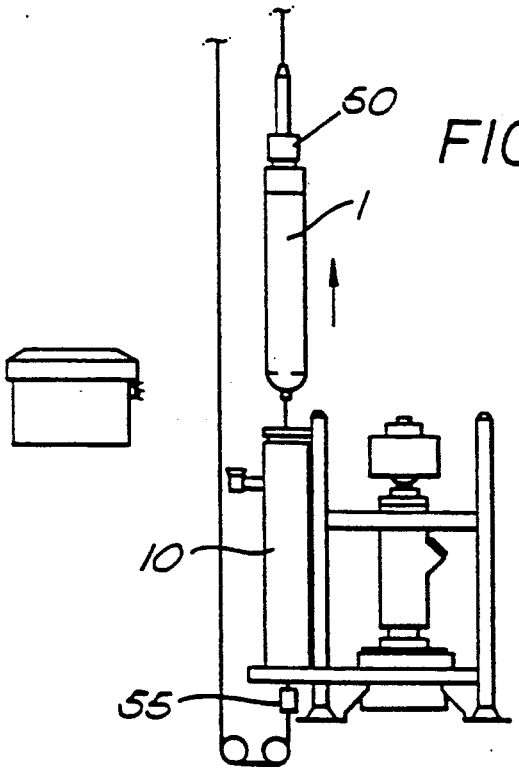

When the installed package is to be retrieved, the retrieval handling tool 50 is lowered from the surface vessel by means of the wire 51 and is mechanically connected to the upper end of the package 1 by the ROV. The return run 32 of the wire is also lowered with the separable link portion at its free end, and the ROV connects this to the other portion on the support bracket as appears from FIG. 12. The return run of the wire thus connected is freed from the bracket and retrieval of the package 1 takes place by means of the running wire as illustrated in FIG. 13.

Figure 14A:
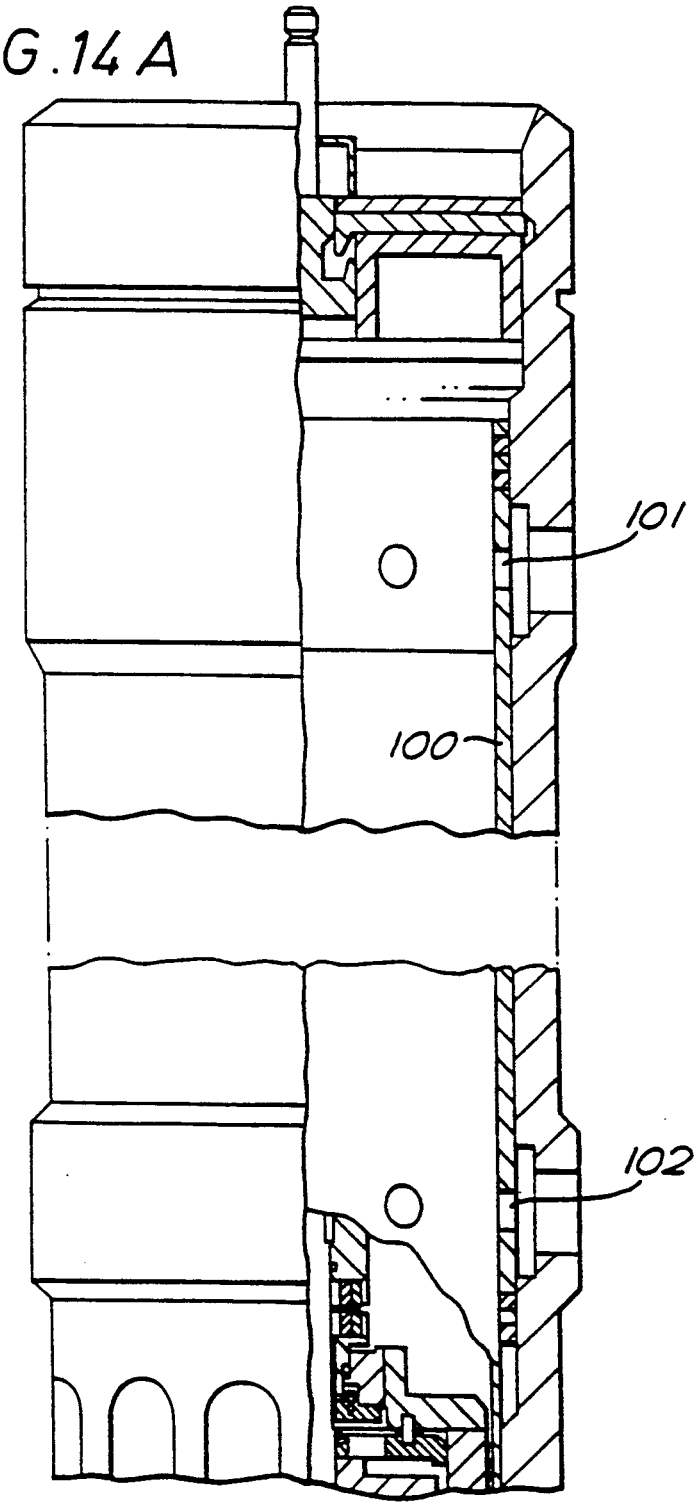
FIGS. 14A and 14B are partially cross-sectional side views together showing a second pump/driver package installed in accordance with the invention within a tubular receptacle on a subsea station.
Figure 14B:
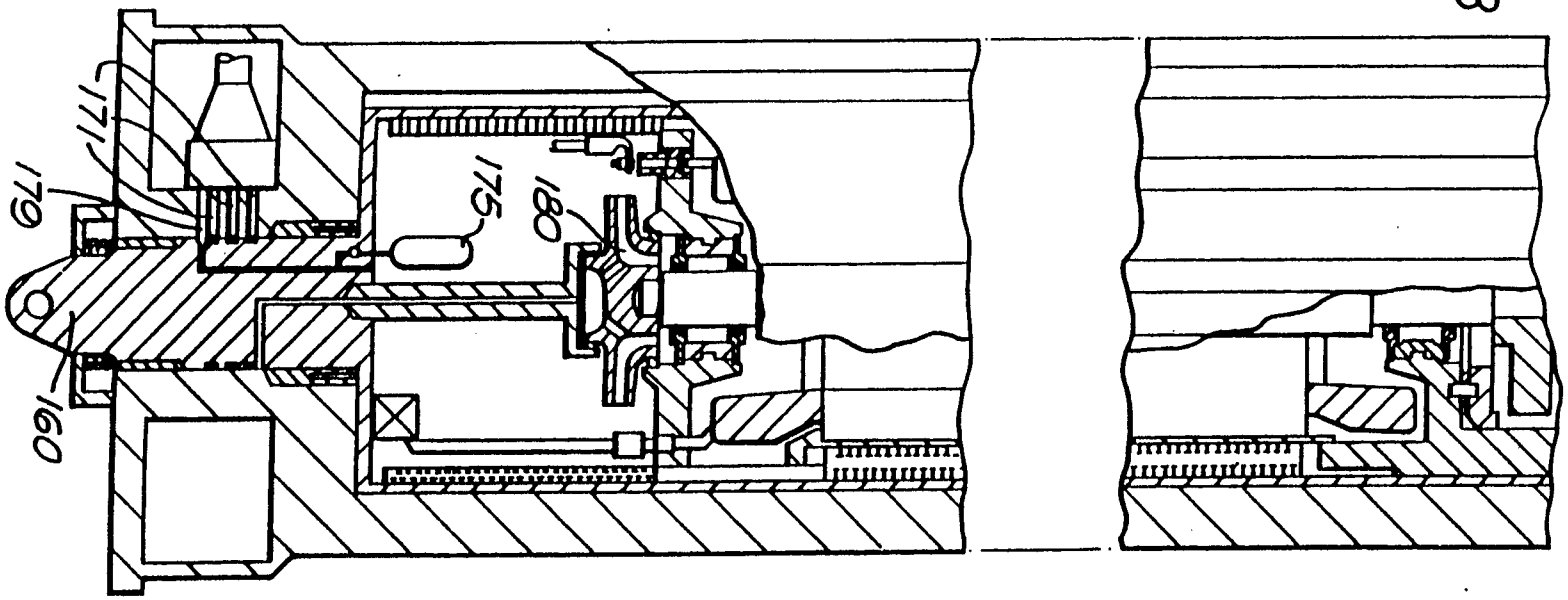

The pump/driver package 100 illustrated in FIGS. 14A and 14B resembles the package 1 of FIGS. 1A and 1B and only points of difference are decribed. The package contains at its lower region an electric motor which drives pump elements located in the upper region to pump fluid received into the casing through an inlet port 101 outwardly of the casing through a discharge port 102. The package 100 is shown received within a connector receptacle 110 of a subsea station, with the inlet and outlet ports in registration with co-operating ports 111 and 112 through the receptacle wall, to which the package is sealed by sealing elements arranged and set similarly to the sealing elements 14 of FIGS. 1A and 1B. Power is supplied to the electric motor through mating contacts at the lower ends of the casing and the receptacle 110 as are more particularly described below with reference to FIGS. 15 and 16.

The installation of the package 100 into the receptacle 110, and its retrieval therefrom is described below with reference to FIGS. 15–21.

The pump/driver package 100 is delivered to and retrieved from a receptacle at a subsea station by way of a handling tool 120 which substantially encloses the package, as shown in FIG. 17 The handling tool 120 comprises a cylindrical casing closed at its upper end at which it is connected to a line 121 by which it is lowered for installation from a surface vessel. An hydraulic umbilical 122 extends from the surface vessel to the tool 120.

Internally, at its upper end, the tool casing mounts a hydraulic cylinder 124 the piston 125 of which protrudes from the lower end axially of the casing to a package handling connector 126 by which the upper end of the pump/driver package 100 is releasably secured within the tool The tool casing extends downwardly beyond the lower end of the package 100 and may be provided externally with a shock absorber 127 to absorb any impact forces that may be experienced on arrival of the tool at the subsea station. The lower end of the pump/driver package 100 is retained concentrically within the handling tool 120 by centralising rollers 129.

Figure 18:
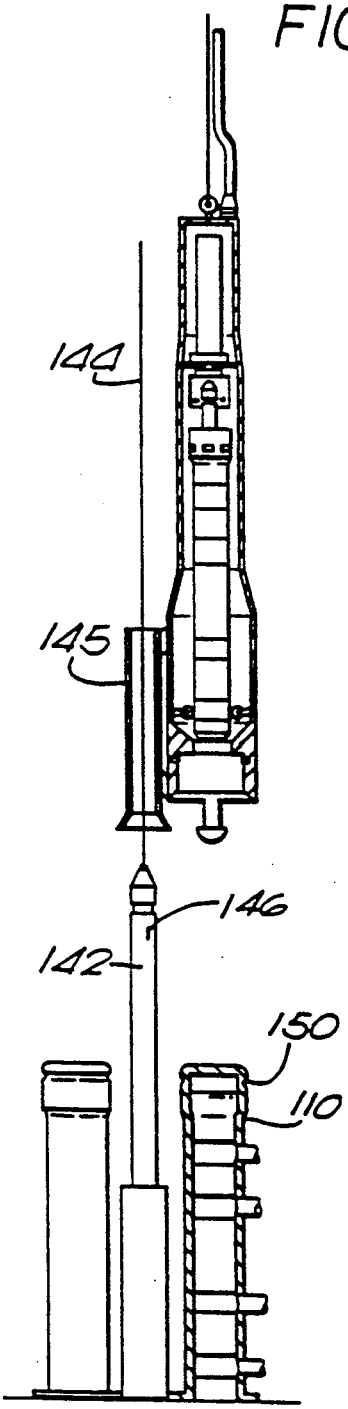

The receptacle 110 is supported upright at the subsea pumping station adjacent a tree by a support frame surrounding the tree in a structure generally similar to that shown in FIGS. 4–9. However adjacent the receptacle 110, as shown in FIG. 18, is an upright guide post 142 with a tapered upper end from which a guide wire 144 extends to a surface vessel. The handling tool 120 carries adjacent its lower end portion a laterally spaced guide sleeve 145, the lower end of which is outwardly flared or funnel shaped, and the axis of which is parallel to the common axis of the package and the handling tool. At its upper end, the guide post 142 is provided with an orientation key 146 which co-operates with an internal helical groove provided in the guide sleeve, to effect correct angular orientation of the tool 120 relative to the receptacle 110 about the axis of the guide post.

Figure 19:
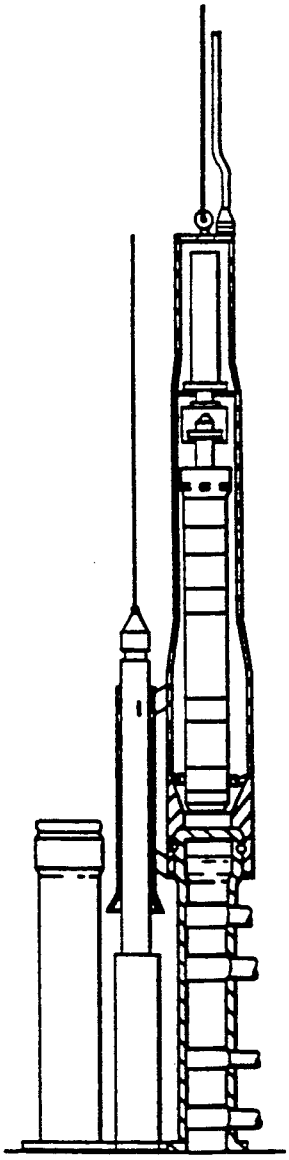

For installation, the guide wire 144 is threaded through the guide sleeve 145 on the surface vessel and the handling tool and pump/driver package assembly is lowered on the line 121 with assistance from a ROV, until the upper end of the receptacle 110 can be received in the lower end of the handling tool, in the position of FIG. 19. The connector receptacle 110 at the subsea station is provided with a locking groove 150 externally around its upper end and the tool casing is provided internally with locking dogs 151 which can be received in the receptacle locking groove in this position.

The package 100 is thus axially aligned with the receptacle 110, and the tension in the running line 121 can be relaxed and the package handling connector 126 can be moved downwardly by extension of the piston 125 from the cylinder 12 to feed the package into the receptacle, as shown in FIG. 19.

Figure 15:
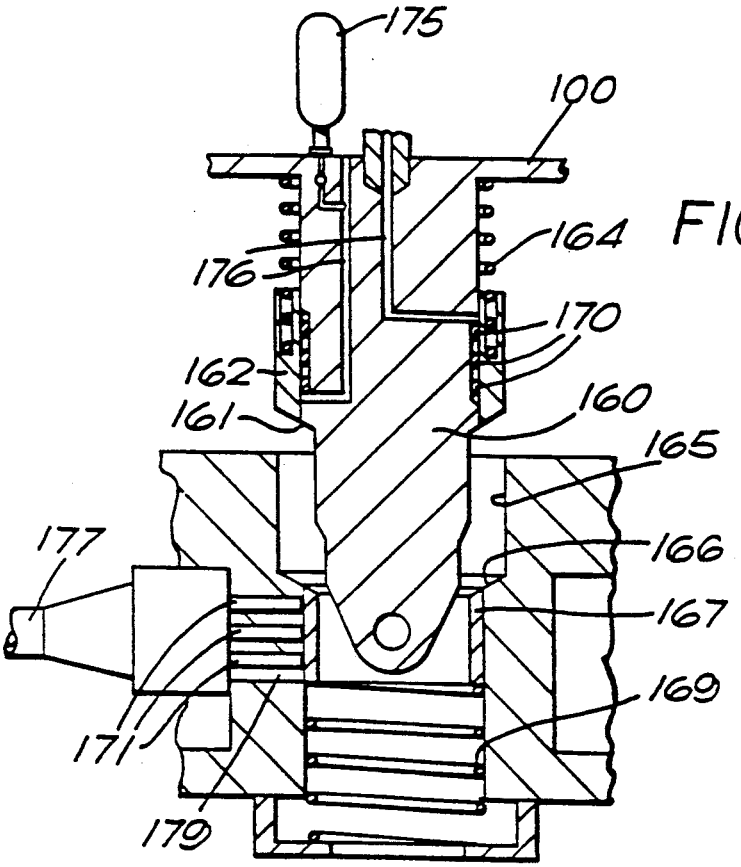
FIG. 15 is a similar view on a larger scale of the lower portion only of the unit of FIGS. 14A and 14B, just prior to completion of installation.

FIG. 15 shows the lower end of the package 100 approaching that of the receptacle 110. The lower end of the package is provided with an axially projecting end member 160 having a tapered shoulder 161 intermediate its ends above which extends a sleeve 162 retained in place by a relaxed compression spring 164 around the end member. The upper end of the receptacle 110 is provided with an orifice 165 shaped to receive the end member and its surrounding sleeve and having an intermediate step 166 for co-operating with the shoulder 161. Beneath the step 166, the orifice contains a sleeve 167 held by a relaxed compression spring 169 in which the lower portion of the end member 160 can be received.

Figure 16:
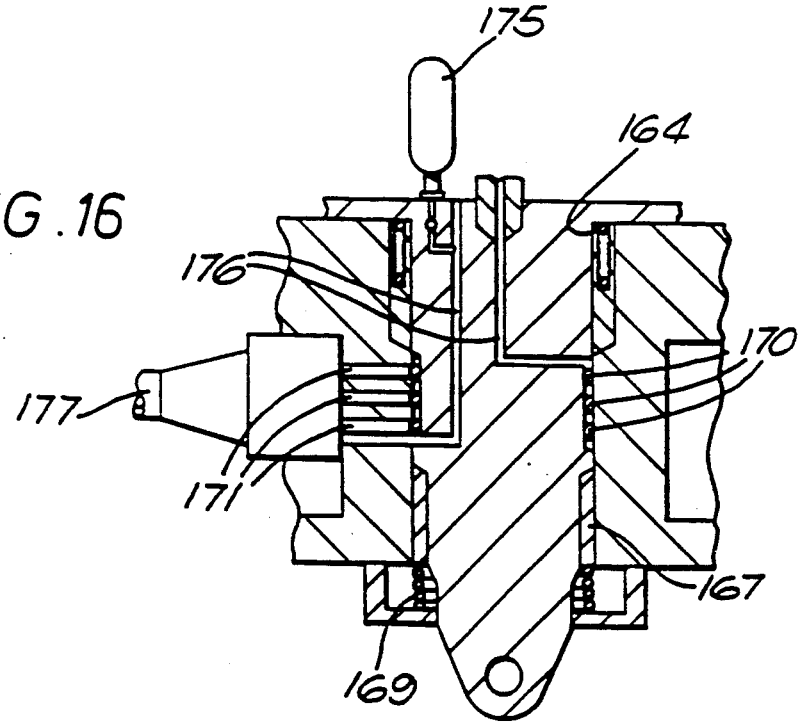
FIG. 16 is a view similar to that of FIG. 15, but with installation complete.

As the end member 160 enters the orifice 165, the shoulder 161 engages the sleeve 167 and moves this downwardly, compressing the spring 169, as the step 166 engages the sleeve 162 to hold this stationary, with compression of the spring 164, until the end position shown in FIGS. 14B, 16 and 20 is reached. Axially spaced electric contacts 170 in the form of rings are carried externally by the end member 160 within the surface region initially covered by the sleeve 162, and mating contacts or contact rings 171 are provided within the orifice 165 in the region initially covered by the sleeve 167. In the end position, the two sets of contacts 170 & 171 have been uncovered from the sleeves and are in engagement.

To ensure good electrical contact between the contact 170 and 171, the contacting surfaces are flushed during installation by fluid, typically a protective oil, supplied from a flushing fluid system. The system illustrated includes an accumulator 175, which is charged on the surface before installation, and operates by oil over-pressure in the motor housing of the package 100. As the protective sleeves 162 begins to expose the contacts 170, the oil in the motor housing is at a pressure higher than prevails outside, so the oil leaks over the contacts through ducts 176 to effect flushing until sealing has been effected. The electrical power supply is carried in from the subsea station to the contacts 171 within piping 177 which conveys also the protective oil into the motor housing of the package 100 after installation by way of a duct 179 which extends through the wall of the receptacle 110. The outlet end of the duct 179 is closed by the sleeve 167 before installation of the package 100 but subsequently communicates with the motor housing by way of one of the ducts 176.

Within the motor housing an impeller 180 driven directly from the motor shaft circulates the oil for lubricating, protection and cooling. The protective oil can also be directed to the electrical contacts to provide continuous flushing if desired. Static pressure is applied by way of the duct 179 and oil is supplied to make up for leakage, as through the pump shaft seal.

Once the package 100 has been completely loaded into the receptacle, with electrical connection established as described above, the package seals can be set and testing carried out. The package handling connector 126 is then disconnected from the upper end of the package 100 and withdrawn upwardly within the tool 120 by the cylinder 124. The handling tool is then retrieved to surface as shown in FIG. 21.

An alternative installation system for placing the pump/driver package 100 within the receptacle 110 by means of a modified form of the handling tool 120, is illustrated in FIGS. 22 and 23.

The subsea station again generally resembles that of FIGS. 4–9, but the frame supports above the open upper end of the receptacle 110 a guide funnel 200 by which the lower end of the modified handling tool 220 is guided with assistance from a ROV before it is brought into engagement with the upper end of the receptacle.

The handling tool 220 differs from the tool 120 previously described in that the guide sleeve 145 is omitted, and shock absorber means are provided. The shock absorber means comprise an abutment ring 221 slidably mounted on the exterior of the tool and shaped to engage the interior of the funnel 200. At the right-hand side of FIG. 23, the ring 221 is shown in the position of initial contact with the funnel in which it is held in its normal relative position to the tool 220 by rods 222 extending from shock absorber cylinders 224. The lower end of the tool 220 is in this condition located just above the upper end of the receptacle 110.

The ring 221 has been moved upwardly on the tool 220 to an end position of engagement with the cylinders 224, and the locking dogs 151 have latched into the groove 150 on the receptacle. The delivery of the package 100 from the tool 220 into the receptacle follows as described above, as do the further steps and the eventual separation and retrieval of the tool.

The installation and retrieval techniques of the invention so far described are applicable to other than pump/driver packages, for example, to the valve package 250 shown in FIG. 24 after installation in a receptacle 251 at the subsea station The valve package 250 can be installed within the receptacle 251, and retrieved from it, by any of the techniques described above with reference to FIGS. 4–13 and 17–23.

The valve package 250 comprises a suspension or locking head 252 which can function similarly to the head of the pump-driver package 1, from which downwardly extends a circular cylindrical body 254. The body 254 is provided internally with four axially spaced valve chambers 255–258 each communicating through a radially extending upper and a lower conduit 260 and 261 with respective ports at the exterior of the body, and through an intermediate conduit 262 extending radially in the opposite direction to a third port at the exterior of the body. A central bore in the body 254 extends through the valve chambers and accommodates a spool member 265 which is adjustable in position lengthwise to effect desired valve connections.

In the uppermost and next to lowest valve chambers 255 and 257, the spool member 265 has a portion of restricted diameter on which are received two annular valve members 266 urged apart by a coiled compression spring 267 between them. The valve members 266 control communication between the intermediate ducts 262 and the upper and lower ducts 260 and 261. In each of the other valve chambers, 256 and 258, coiled compression springs 269 act on respective upper and lower annular valve members 270 to urge these respectively downwardly and upwardly against shoulders formed on the spool member 262. The valve members 270 again control communication between the intermediate duct and the upper and lower ducts of the valve chamber 256 and 258.

In the position illustrated, the spool member 262 is in a neutral position in which fluid flow through the valve body is prevented. At its lower end, the member 262 carries a piston member 275 movable within a cylindrical chamber 276 at the lower end of the valve member. Admission of pressure fluid to the chamber 276 above or below the piston 275, through aligned conduits in the receptacle 251 and the body 254, effects movement of the member 262 downwardly or upwardly respectively. In the upper spool member position, the communication is permitted between the intermediate duct and the lower duct of the valve chambers 255 and 257, and between the intermediate duct and the upper duct of the valve chambers 256 and 258. In its lower position, the spool member 262 permits communication between the intermediate duct and the upper ducts of the valve chambers 255 and 257, and between the intermediate duct and the lower duct of the chambers 256 and 258.

The receptacle 251 is provided with internal annular grooves 280 registering with the ports at the outer surface of the body 254 and ducts 281 extend outwardly through the receptacle wall from the grooves to equipment of the subsea station. Thus, valve chamber 255 can control supply of crude oil from the subsea station tree to either of two pumps at the station and the chamber 256 controls connection of the pump discharges to production tubing. The control of pressure fluid supplies to and exhausts from the respective pump turbines can be effected through the valve chamber 257 or 258.

To ensure integrity of the fluid communications between the body 254 and the receptacle 251, the former supports seal means (not shown) which can be equivalent to those described with reference to FIGS. 1A and 1B.

The invention can be embodied in a variety of ways other than as specifically described and illustrated herein.

I claim:

1. Apparatus comprising a subsea station and an operational package for retrievable installation at said subsea station, comprising:

a receptacle at said subsea station for receiving said operational package therein, co-operable connection means on said package and said receptacle, said co-operable connection means being adapted to establish at least one of fluid and electrical communication between said package and said receptacle on reception of said package within said receptacle, means for establishing a running loop extending from a surface vessel downwardly through said receptacle and upwardly to said surface vessel outside the receptacle, whereby said operational package can be moved on and guided by said loop from said surface vessel into said receptacle, a connector in said running loop below said package, said connector being separable into re-connectable portions, and means on said subsea station for releasably supporting thereon the one of said connector portions nearer to said package after installation for re-connection when said running loop is re-established for retrieval of said operational package.

2. The apparatus of claim 1 wherein said receptacle has a central axis and further comprising guide means for said running loop at said subsea station, said guide means aligning said loop along said central axis of said receptacle.

3. The apparatus of claim 1 further comprising a handling tool from which said package is suspended, co-operating releasable connecting means on said handling tool and said receptacle, and operating means operative between said handling tool and said package to effect movement of said package inwardly of said receptacle after connection of said connecting means.

4. Apparatus comprising a subsea station and an operational package for retrievable installation at said subsea station, comprising:

a receptacle at said subsea station adapted to receive said operational package therein, co-operable connection means on said operational package and said receptacle, said co-operable connection means being adapted to establish at least one of fluid and electrical communication between said operational package and said receptacle on installation of said operational package within said receptacle, a handling tool, means suspending said package from said handling tool, co-operating releasable connector means on said handling tool and said receptacle, and hydraulically actuable operating means located at the upper end of said operational package, said operating means being actuable to effect movement of said operational package inwardly of said receptacle after connection of said connector means.

5. Apparatus comprising a subsea station and an operational package adapted to be retrievably installed at said subsea station in operative relationship thereto, comprising:

first and second surface regions of said subsea station and said package respectively, said first and second surface regions being in juxtaposition when said operational package is installed at said subsea station, first and second electrical contact means at said first and second surface regions respectively, said electrical contact means being engaged to establish electrical communication between said operational package and said subsea station when said operational package is installed at said subsea station, first duct means opening at one of said first and second surface regions, flushing fluid supply means adapted to supply flushing fluid through said first duct means to flush said electrical contact means during installation of said operational package at said subsea station, and second duct means opening at the other of said first and second surface regions, said second duct means being adapted to communicate with said first duct means to establish fluid communication between said operational package and said subsea station after said operational package has been installed at said subsea station.

6. The apparatus of claim 5 further comprising a cover member closing said first duct means prior to installation of said operational package at said subsea station, said cover member being displaceable to expose said first duct means during installation of said operational package at said subsea station, and wherein said flushing fluid supply means comprises a pressurized fluid source communicating with said first duct means to supply pressurized flushing fluid thereto.

7. The apparatus of claim 6 wherein said cover means covers said first electrical contact means prior to installation of said operational package at said subsea station and is adapted to expose said first electrical contact means on installation.

8. The apparatus of claim 6 further comprising a second cover member closing said second duct means and being displaceable to expose said duct means to expose said second duct means during installation of said operational package at said subsea station.

9. The apparatus of claim 7 wherein said first and said second cover members cover respectively said first and said second electrical contact means prior to installation of said operational package at said subsea station, and are adapted to expose said first and said second electrical contact means on said displacement of said cover members.

10. Apparatus comprising a subsea station and an operational package for retrievable installation at said subsea station, comprising:

first and second surface areas of said subsea station and said operational package respectively, said first and second surface areas being located so as to be directly opposed when said operational package is installed at said subsea station, first and second electrical contact means at said first and second surface areas respectively, said electrical contact means being in engagement when said operational package is installed at said subsea station to thereby establish electrical communication between said operational package and said subsea station, fluid passage means extending to an outlet within said second surface area, cover means closing said outlet and covering said second electric contact means prior to installation of said operational package at said subsea station, said cover being displaceable during installation of said operational package at said subsea station to expose said outlet and said second electrical contact means, pressurized fluid supply means in said operational package in communication with said passage means, whereby said first and second electrical contact means are flushed by said fluid during installation of said operational package at said subsea station on displacement of said cover means.

11. The apparatus of claim 9 further comprising a second passage extending to an outlet within said first surface region and communicating with said first passage means when said operational passage is installed at said subsea station, and means at said subsea station for supplying protective fluid to said operational package by way of said second and first passage means.

12. The apparatus of claim 11 further comprising within said operational package an electric motor housing and an electric motor in said housing, and wherein said first passage means communicates with said electric motor housing for the supply of said protective fluid thereto.

13. The apparatus of claim 12 wherein said pressurized fluid supply means comprises an accumulator in said electric motor housing.

14. Apparatus comprising a subsea station and an operational package adapted to be retrievably installed at said subsea station in operative relationship thereto, comprising:

first and second surface regions of said subsea station and said package respectively, said first and second surface regions being directly opposed when said operational package is installed at said subsea station, an electric power source in said subsea station, a protective oil source in said subsea station, a motor housing within said operational package, an electric motor within said motor housing, first and second electrical contact means at said first and second surface regions respectively, means connecting said first and second electric contact means respectively with said electric power source and with said electric motor, said electrical contact means being engaged to establish electrical communication between said electric power source and said electric motor when said operational package is installed at said subsea station, first and second ducts opening respectively at said first and second surface regions, said first and second ducts communicating respectively with said protective oil source and said motor housing, and said first and second ducts being in registration to establish fluid communication between said protective oil source and said motor housing when said operational package is installed at said subsea station.

15. Apparatus comprising:

a subsea station including means providing an orifice having an open upper end and a step separating an upper portion of said orifice from a restricted lower portion thereof, first connection means comprising at least one of electrical and fluid connection means exposed at said lower orifice portion, an operational package adapted to be retrievably installed at said subsea station and having a lower end member receivable in said orifice when so installed, said lower end member having a step separating an upper portion of said lower end member receivable in said upper portion of said orifice from a lower portion of said lower end member receivable in said lower portion of said orifice, a first sleeve within said orifice and covering said first connection means, first spring means biassing said sleeve, said first sleeve being displaceable downwardly within said orifice against the bias of said spring means to expose said first connection means on reception of said end member in said orifice, second connection means comprising at least one of electrical and fluid connection means exposed at said end member lower portion, a second sleeve around said end member lower portion and having a first position covering said end member connection means, and second spring means biassing said second sleeve, said second sleeve being movable upwardly against said second spring means bias to free said second connection means on reception of said end member in said orifice to permit co-operable engagement between said first and second connection means.

16. The apparatus of claim 15 wherein said first and said second connection means comprise respectively first and second co-operable electric contact members and further comprising a pressurized flushing fluid source in said operational package and a duct communicating said fluid source to the exterior of said package at a position adjacent said second contact members such that said first and second contact members are flushed by said flushing fluid on downward displacement of said second sleeve.

17. The apparatus of claim 16 further comprising a passage in said subsea station, said passage communicating with said duct to establish fluid communication with said operational package following installation of said package at said subsea station.

18. The apparatus of claim 13 wherein said first and said second connection means comprise electric contact means adapted to engage together where said end member is received within said orifice, and further comprising a source of flushing fluid in said operational package, passage means communicating said flushing fluid source with said outlet, a flushing fluid outlet located to be exposed at said end member lower portion, closed by said second sleeve in said first position thereof and freed on said movement of said second sleeve, whereby flushing of said electrical connection means is enabled on reception of said end member in said orifice.

* * * * *